US005927770A

United States Patent [19]

Huang

[11] Patent Number: 5,927,770

[45] Date of Patent: Jul. 27, 1999

[54] DOOR LOCK

[76] Inventor: Mao-Lien Huang, No. 32, Lane 778, Hua Cheng Rd., Hsinchuang City, Taipei Hsien, Taiwan

[21] Appl. No.: 09/010,551

[22] Filed: Jan. 22, 1998

[51] Int. Cl.[6] ..... E05B 15/00

[52] U.S. Cl. ..... 292/169.14; 292/337

[58] Field of Search ..... 292/169.15, 337, 292/58, 63, 71, 169.13, 169.14, 169.18, 169, 346

[56] References Cited

U.S. PATENT DOCUMENTS 1,514,528 11/1924 Hurd .
1,706,486 3/1929 Gasey .
2,107,299 2/1938 Kilpatrick .
3,172,691 3/1965 Russell .
5,529,351 6/1996 Donald ..... 292/254
5,794,991 8/1998 Smallegan ..... 292/169
5,816,629 10/1998 Donald ..... 292/254

*Primary Examiner*—Darnell M. Boucher
*Assistant Examiner*—Gary Estremsky
*Attorney, Agent, or Firm*—Rosenberg, Klein & Bilker

[57] ABSTRACT

A door lock which includes a hollow latch bolt coupled to a link by a slip joint, a dead bolt pivoted to the link and adapted to stop the latch bolt from backward movement when forced into engagement with a strike plate.

7 Claims, 9 Drawing Sheets

DOOR LOCK

BACKGROUND OF THE INVENTION

The present invention relates to door locks, and more particularly to such a door lock which comprises a hollow latch bolt coupled to a link by a slip joint, and a dead bolt pivoted to the link and adapted to stop the latch bolt from backward movement when forced into engagement with a strike plate.

Regular door locks are generally equipped with a latch bolt and a dead bolt. However, the bolts of these conventional door locks can easily be destroyed or moved out of the strike plate with a pry.

SUMMARY OF THE INVENTION

The present invention provides a door lock which eliminates the aforesaid problem. According to the preferred embodiment of the present invention, the door lock comprises a casing having a face plate at a front side thereof, the face plate having a through hole; a hollow latch bolt moved in and out of the casing through the through hole on the face plate, the hollow latch bolt comprising a transverse pin hole; a hollow link having two longitudinal slots bilaterally aligned at a front end thereof and coupled to one end of the hollow latch bolt, and a rear end; a first pivot pin mounted in the transverse pin hole on the hollow latch bolt and the longitudinal slots on the hollow link; a second pivot pin transversely mounted on the hollow link behind the first pivot pin; a dead bolt turned about the second pivot pin and moved between a first position where the dead bolt is received inside the link, and a second position where the dead bolt partially moved out of said link, the dead bolt comprising a guide hole which receives the first pivot pin, and a stop flange projecting into the guide hole and adapted to stop the first pivot pin from backward movement when the latch bolt is pushed backwards by an external force; first spring means mounted on the second pivot pin and adapted to push the dead bolt from the first position to the second position; a slide mounted inside the casing and coupled thereto by a slip joint and connected to the rear end of the hollow link; second spring means mounted around the hollow link and stopped between the hollow latch bolt and the slide, and adapted to push the hollow latch bolt axially forwards from slide; third spring means adapted to push the slide outwards, causing the latch bolt to be moved out of the through hole on the face plate by the slide through the hollow link; and a follower mounted in the casing, and turned with a doorknob to pull the slide backwards in moving the latch bolt in the through hole on the face plate.

DETAILED DESCRIPTION OF THE PREFERRED EMBODIMENT

Figure 1:
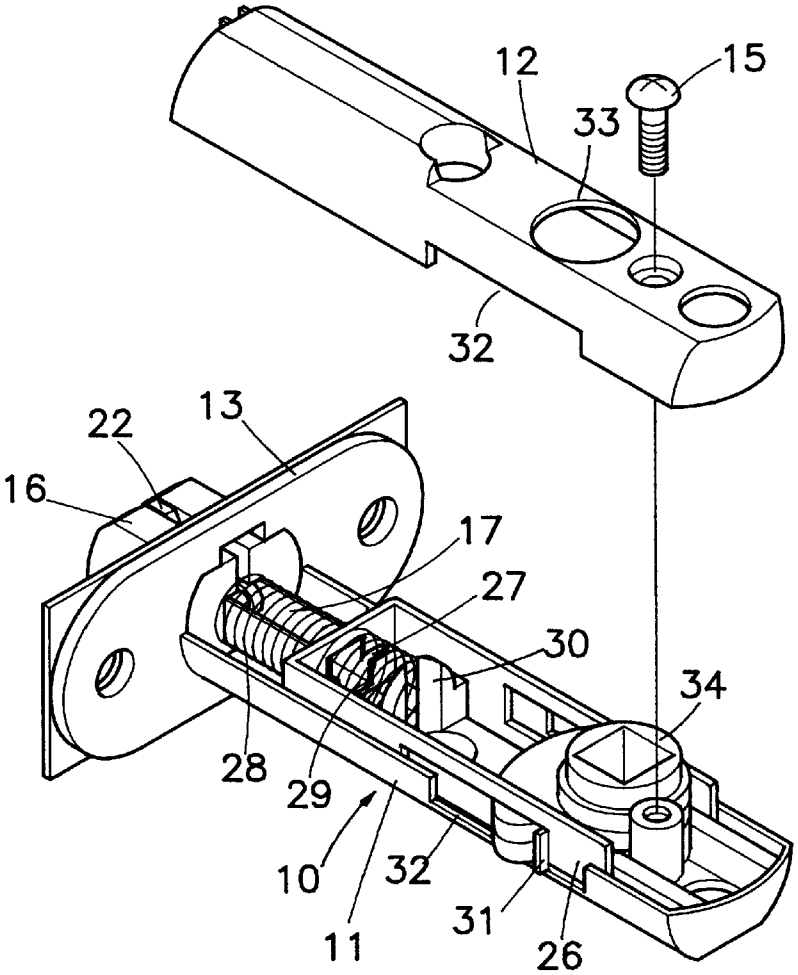
FIG. 1 perspective view of a door lock according to the present invention showing the second half shell of the casing opened from the first half shell thereof.
Figure 2:
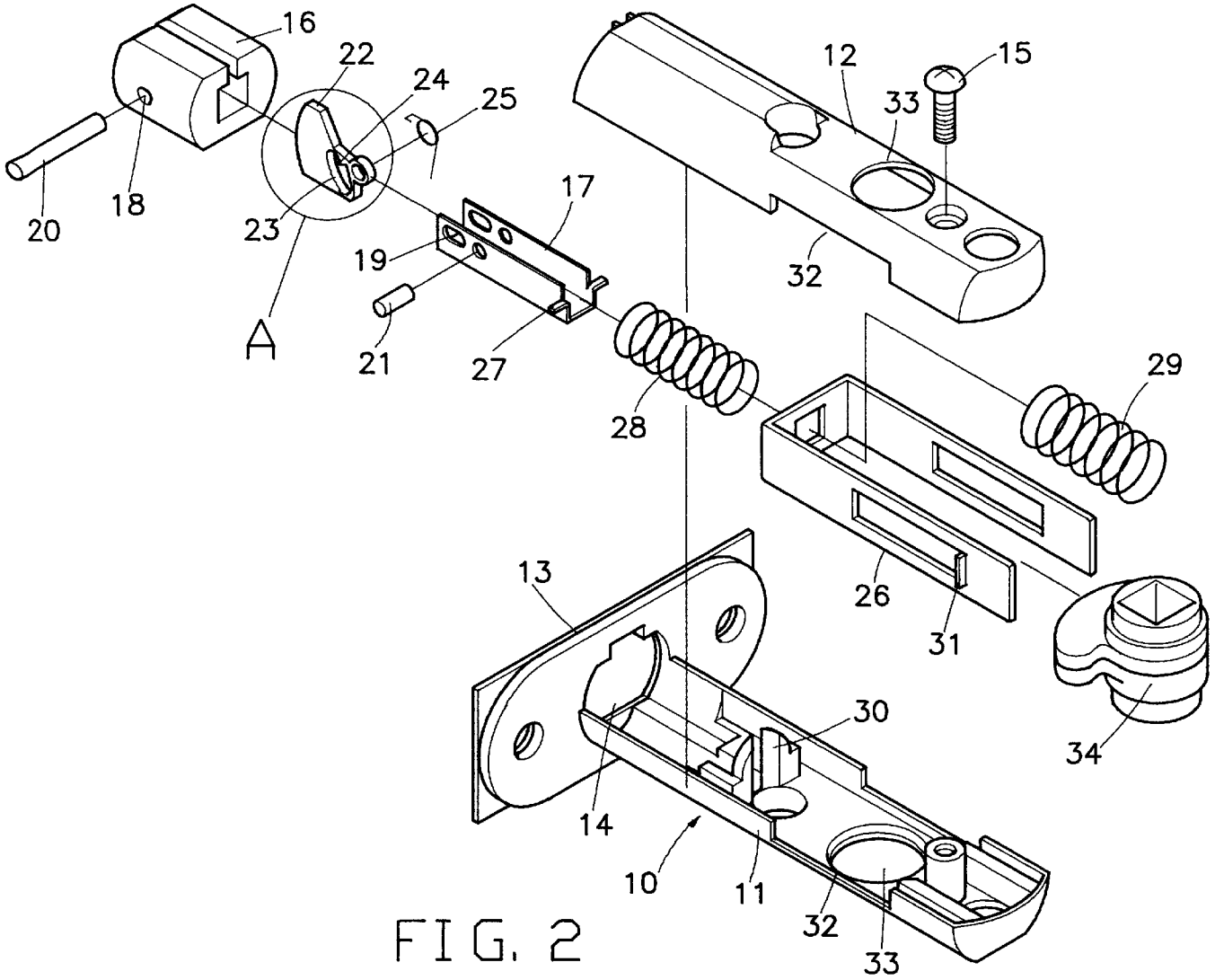
FIG. 2 is an exploded view of the door lock shown in FIG. 1.
Figure 2A:
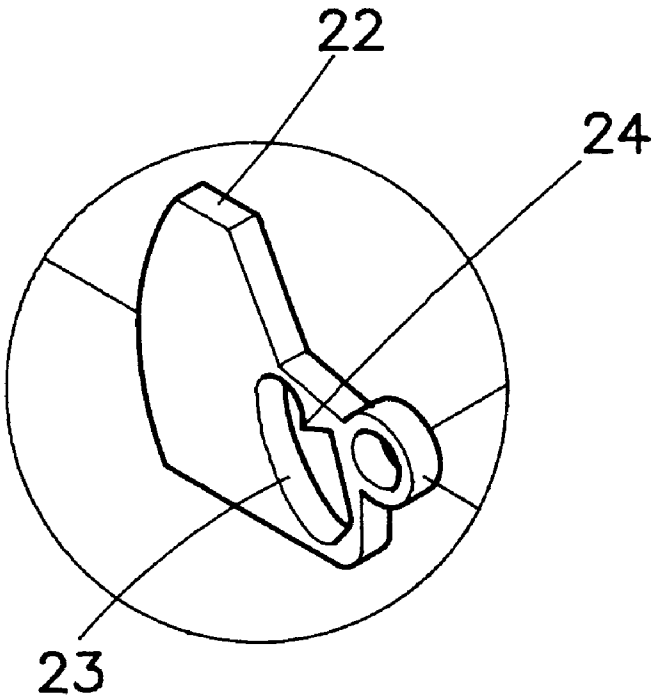
FIG. 2A is an enlarged view of the deadbolt of FIG. 2.
Figure 3:
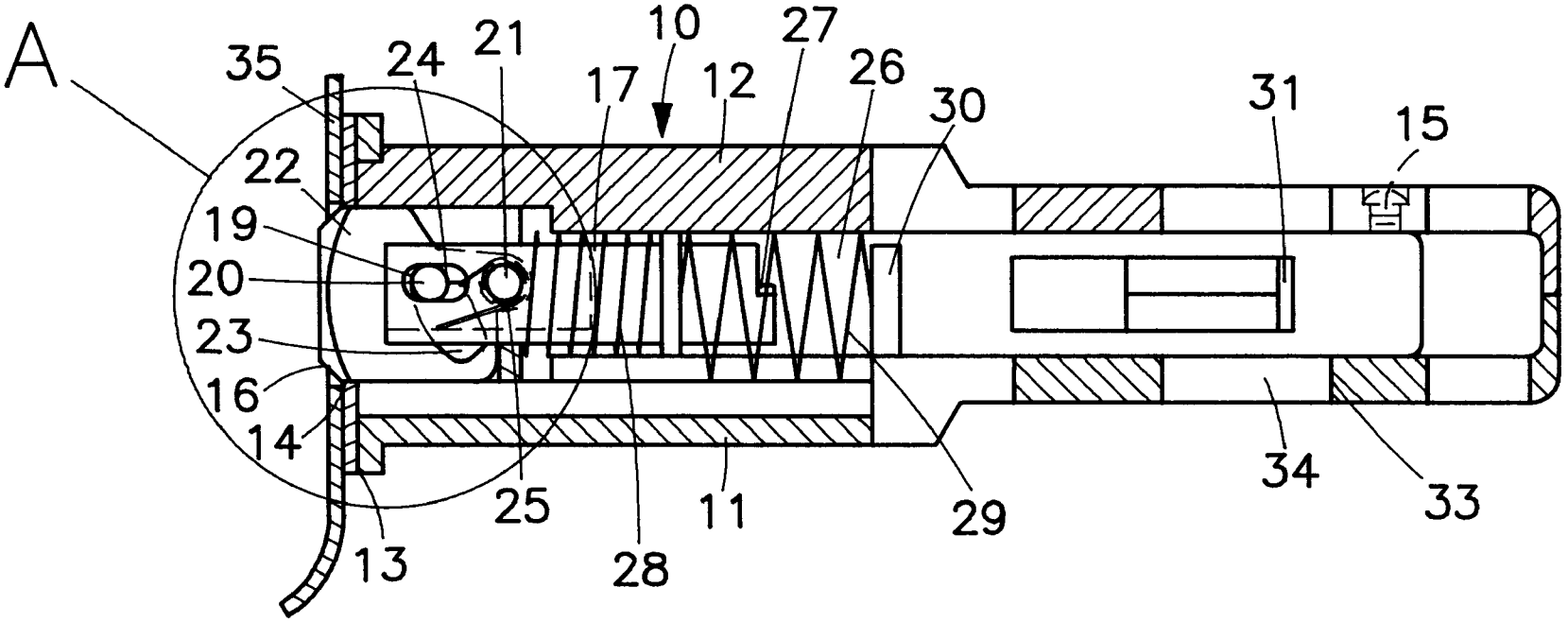
FIG. 3 a sectional view of the present invention, showing the dead bolt moved to the first position and received in the link.
Figure 4:
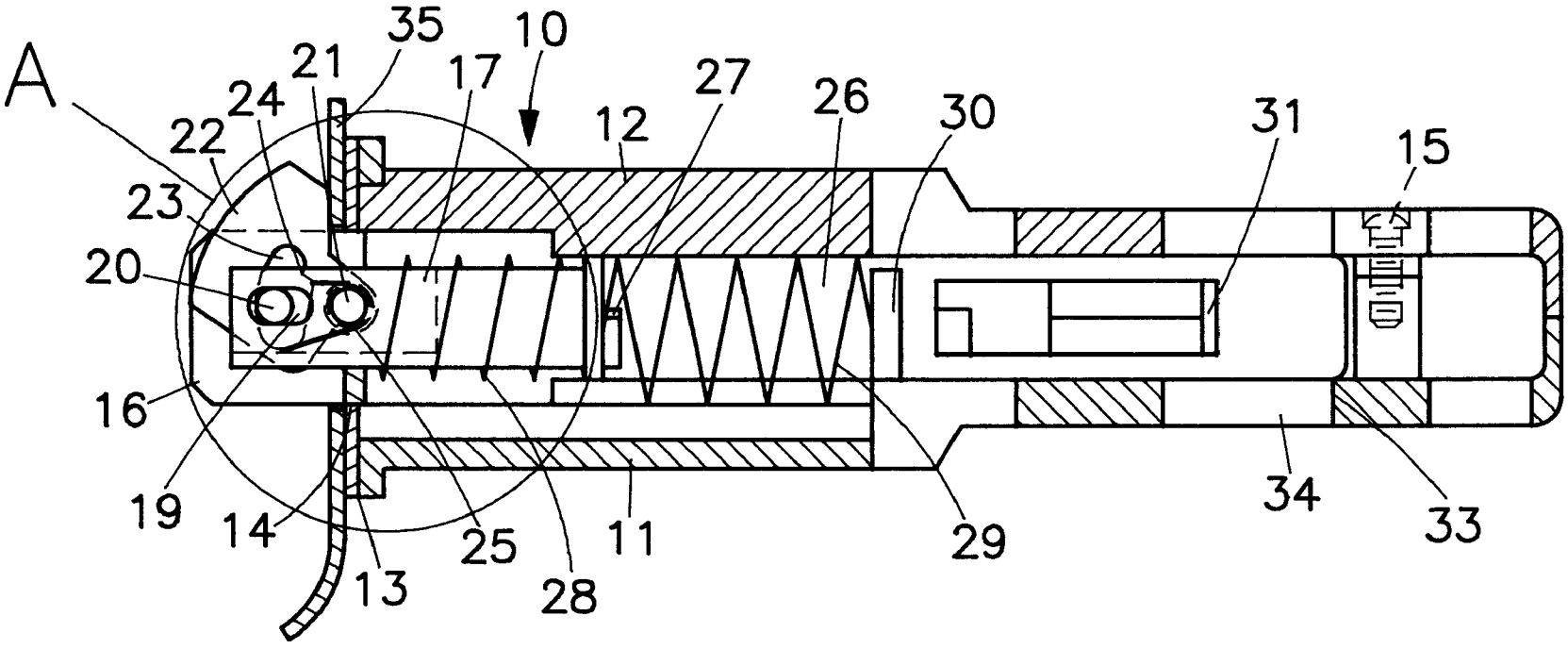
FIG. 4 is similar to FIG. 3 but showing the latch bolt moved into engagement with the strike plate, the dead bolt moved to the second position and engaged with the strike plate.

Referring to Figures from 1 to 4, a door lock in accordance with the present invention comprises a casing 10. The casing 10 is comprised of a first half shell 11, a second half shell 12 covered on the first half shell 11 and secured thereto by a screw 15, and a face plate 13 integral with one end of the first half shell 11. The face plate 13 comprises a through hole 14 on the middle. A hollow latch bolt 16 is moved in and out of the through hole 14 on the face plate 13. The hollow latch bolt 16 is preferably made having at least one beveled edge at its front end (by means of the beveled edge, the hollow latch bolt can easily be moved into the lock hole on the matched strike plate). A link 17 is coupled to the hollow latch bolt 16. The link 17 has a substantially U-shaped cross section, two longitudinal slots 19 aligned at its two opposite upright side walls near its front end. A pivot pin 20 is mounted in a transverse pin hole 18 on the hollow latch bolt 16 and inserted through the longitudinal slots 19 on the link 17, permitting the link 17 to be secured to the hollow latch bolt 16 by a slip joint. A dead bolt 22 is pivoted to the link 17 by a pivot pin 21. The dead bolt 22 can be turned about the pivot pin 21, and moved between a first position where the dead bolt 22 is received inside the link 17 (see FIG. 3), and a second position where the dead bolt 22 is partially moved out of the link 17 (see FIG. 4). The dead bolt 22 comprises an arched guide hole 23 which receives the pivot pin 20, and a stop flange 24 projecting into the arched guide hole 23. A torsional spring 25 is mounted on the pivot pin 21, having one end connected to the link 17, and an opposite end connected to the dead bolt 22. The torsional spring 25 imparts an outward pressure to the dead bolt 22, causing the dead bolt 22 to be moved to the second position.

A slide 26 is mounted in the casing 10 and connected to one end of the link 17 remote from the latch bolt 16. The link 27 has two stop rods 27 bilaterally raised from its rear end, which stop the link 27 from escaping out of the constraint of the slide 26. A first compression spring 28 is mounted around the link 17 and stopped between the hollow latch bolt 16 and the slide 26. The first compression spring 28 imparts a forward pressure to the hollow latch bolt 16, causing the hollow latch bolt 16 to be axially pushed forwards from the slide 26. A second compression spring 29 is mounted within the slide 26, and connected between the slide 26 and an upright stop member 30 inside the first half shell 11 of the casing 10. The second compression spring 29 imparts a forward pressure to the slide 26, causing the slide 26 to be axially pushed forwards from the upright stop member 30. The slide 26 comprises two projecting rods 31 raised from its two opposite side walls, and respectively inserted into two longitudinal sliding slots 32 at two opposite lateral sides of the casing 10. A follower 34 is mounted in a transverse through hole 33 on the casing 10, and turned with a doorknob (not shown) to pull the slide 26 axially backwards.

Figure 3A:
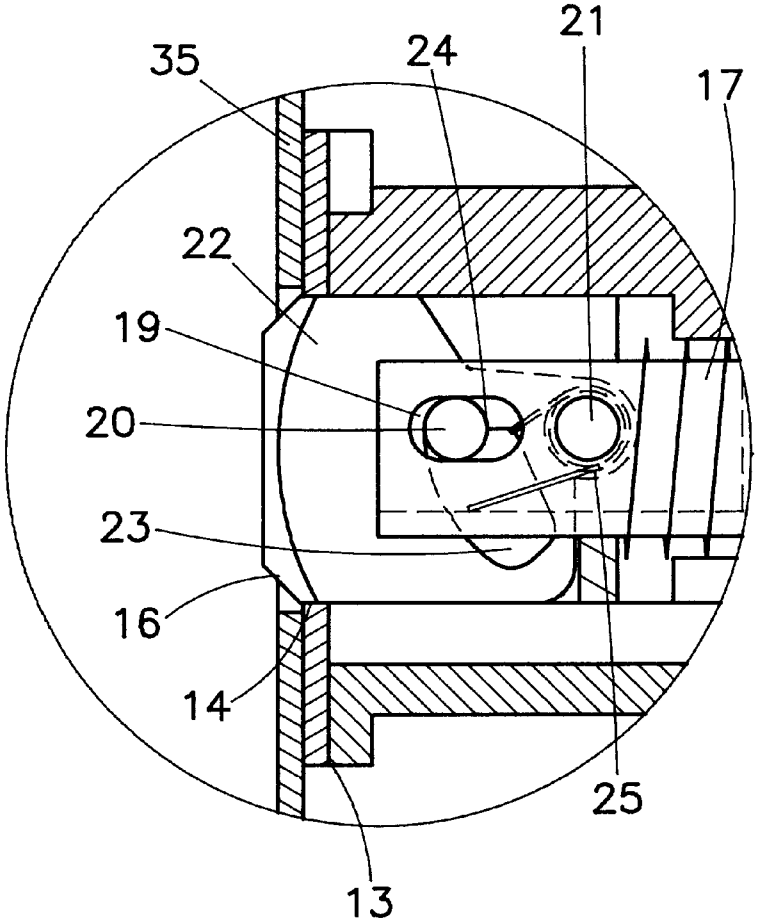
FIG. 3A is an enlarged view of the front part of FIG. 3.
Figure 4A:
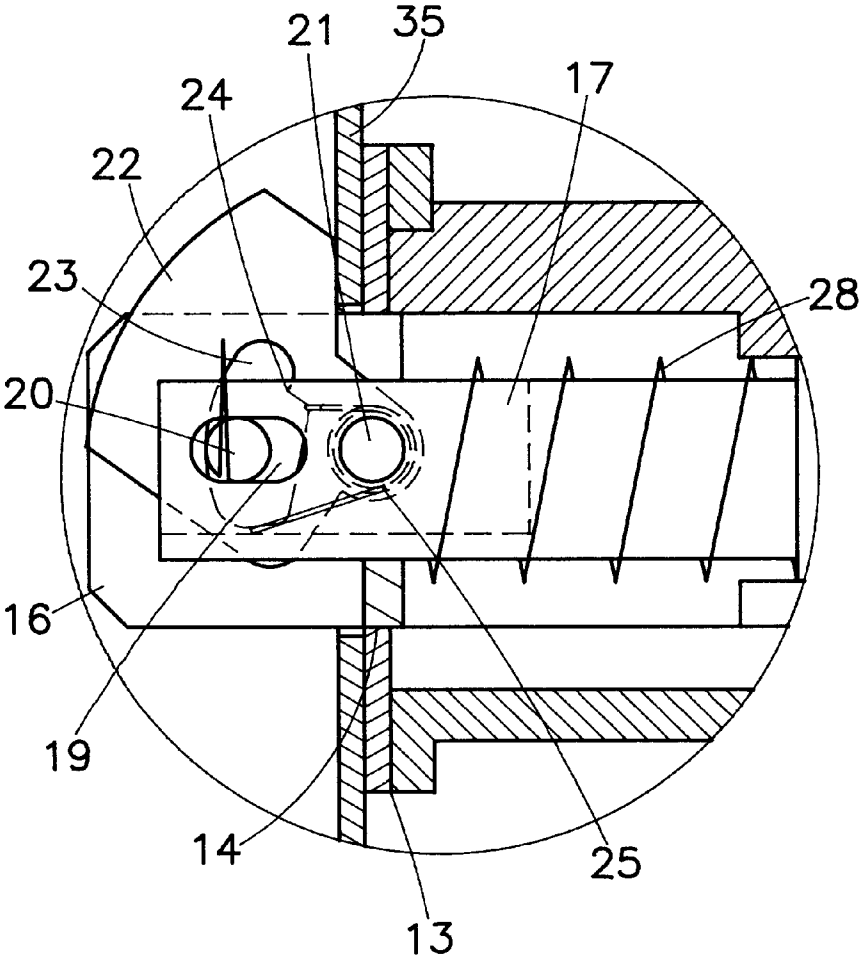
FIG. 4A is an enlarged view of the front part of FIG. 4.
Figure 5:
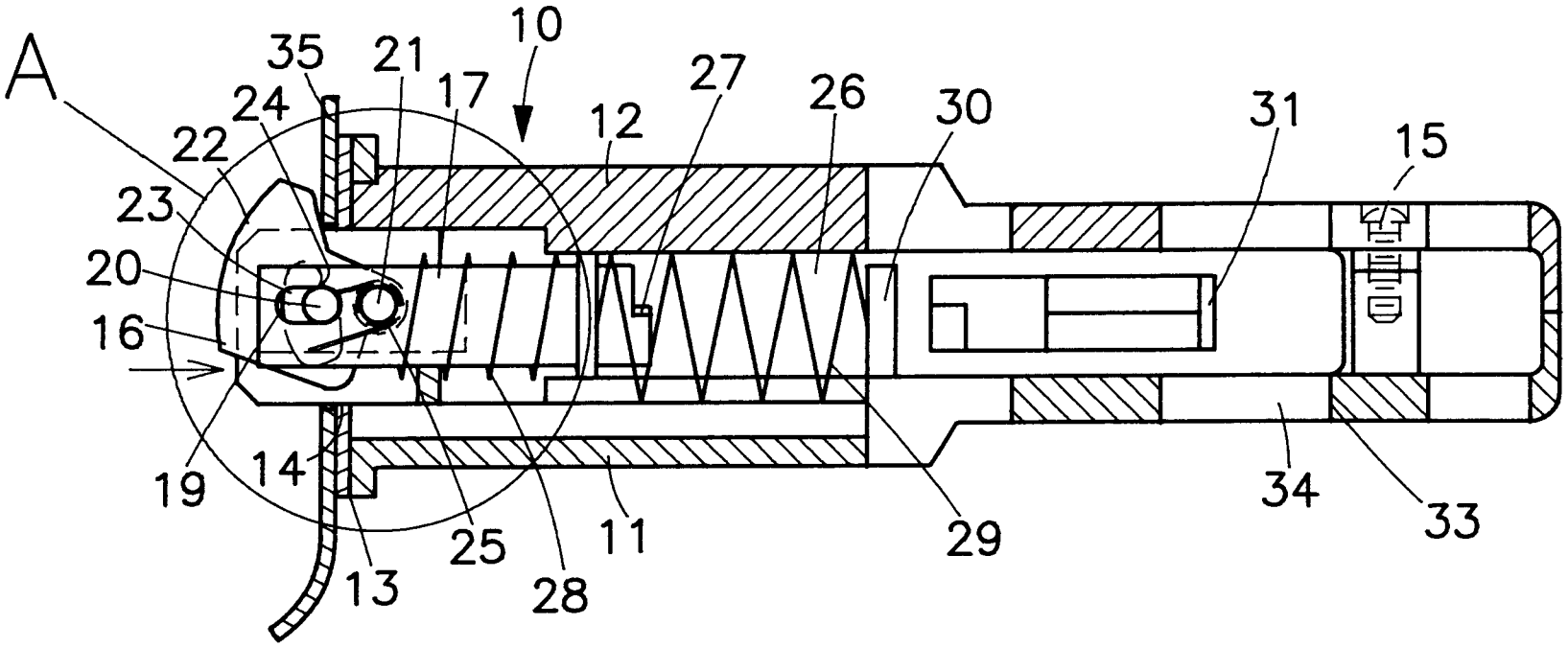
FIG. 5 is similar to FIG. 4 but showing the latch bolt pushed backwards, the pivot pin on the latch bolt stopped at the stop flange of the dead bolt.
Figure 5A:
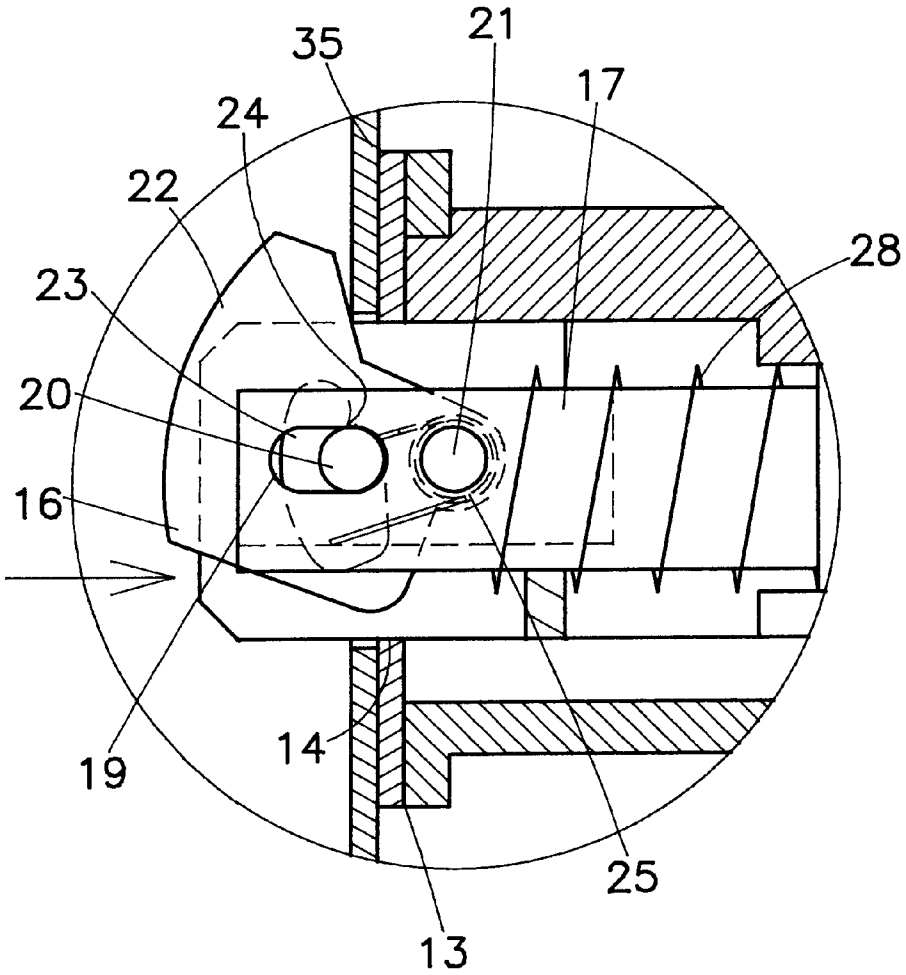
FIG. 5A is an enlarged view of a portion of FIG. 5.

Referring to FIG. 5 and FIGS. 3 and 4 again, when closing the door, the latch bolt 16 is moved over the strike plate 35 on the door frame and forced backwards and received in the through hole 14 on the face plate 13 of the casing 10, and at the same time the dead bolt 22 is forced downwards and moved from the second position to the first position (see FIGS. 3 and 3A); when the latch bolt 16 is moved into alignment with the lock hole on the strike plate 35, the first compression spring 28 and the second compression spring 29 force the latch bolt 16 out of the through hole 14 on the face plate 13 into the lock hole on the strike plate 35, and at the same time the dead bolt 22 is forced upwards and moved from the first position to the second position and hooked on the strike plate 35 (see FIGS. 4 and 4A). If a thief pushes the latch bolt 16 backwards with a pry, the pivot pin 20 will be moved with the latch bolt 16 along the longitudinal slots 19 on the link 17 and then stopped from further backward movement by the stop flange 24 in the arched guide hole 23 on the dead bolt 22, causing the dead bolt 22 unable to be moved back from the second position to the first position, and therefore the dead bolt 22 is maintained hooked on the strike plate 35 (see FIG. 5). Therefore, the door cannot be opened with a pry.

While only one embodiment of the present invention has been shown and described, it will be understood that various modifications and changes could be made thereunto without departing from the spirit and scope of the invention disclosed.

What the invention claimed is:

1. A door lock comprising:

a casing having a face plate at a front side thereof, said face plate having a through hole;

a hollow latch bolt moved in and out of said casing through the through hole on said face plate, said hollow latch bolt comprising a transverse pin hole;

a hollow link having two longitudinal slots bilaterally aligned at a front end thereof and coupled to one end of said hollow latch bolt, and a rear end;

a first pivot pin mounted in the transverse pin hole on said hollow latch bolt and the longitudinal slots on said hollow link;

a second pivot pin transversely mounted on said hollow link behind said first pivot pin;

a dead bolt turned about said second pivot pin and moved between a first position where said dead bolt is received inside said link, and a second position where said dead bolt is partially moved out of said link, said dead bolt comprising a guide hole which receives said first pivot pin, and a stop flange projecting into said guide hole and adapted to stop said first pivot pin from backward movement when said latch bolt is pushed backwards by an external force;

first spring means mounted on said second pivot pin and adapted to push said dead bolt from said first position to said second position;

a slide mounted inside said casing and coupled thereto by a slip joint and connected to the rear end of said hollow link;

second spring means mounted around said hollow link and stopped between said hollow latch bolt and said slide, and adapted to push said hollow latch bolt axially forwards from said slide;

third spring means adapted to push said slide outwards, causing said latch bolt to be moved out of the through hole on said face plate by said slide through said hollow link; and a follower mounted in said casing, and turned with a doorknob to pull said slide backwards in moving said latch bolt in the through hole on said face plate.

2. The door lock of claim 1, wherein said casing is comprised of a first half shell integral with said face plate, and a second half shell covered on said first half shell and fixedly secured thereto by at least one screw.

3. The door lock of claim 1, wherein said hollow latch bolt has at least one beveled edge at a front end thereof.

4. The door lock of claim 1, wherein the guide hole on said dead bolt has an arched shape.

5. The door lock of claim 1, wherein said link comprises a plurality of stop rods bilaterally raised from its rear end and stopped inside said slide.

6. The door lock of claim 1, wherein said third spring means is mounted inside said slide and connected between said slide and an upright stop member inside said casing.

7. The door lock of claim 1, wherein said slide comprises two projecting rods raised from two opposite side walls thereof, and respectively inserted into two longitudinal sliding slots at two opposite lateral sides of said casing.

* * * * *